US008342497B2

(12) United States Patent
Abe

(10) Patent No.: US 8,342,497 B2
(45) Date of Patent: Jan. 1, 2013

(54) SHEET PROCESSING APPARATUS

(75) Inventor: Hideto Abe, Toride (JP)

(73) Assignee: Canon Kabushiki Kaisha, Tokyo (JP)

( * ) Notice: Subject to any disclaimer, the term of this patent is extended or adjusted under 35 U.S.C. 154(b) by 63 days.

(21) Appl. No.: 13/005,034

(22) Filed: Jan. 12, 2011

(65) Prior Publication Data

US 2011/0176849 A1 Jul. 21, 2011

(30) Foreign Application Priority Data

Jan. 18, 2010 (JP) ..... 2010-007868
Dec. 21, 2010 (JP) ..... 2010-283976

(51) Int. Cl.
*B31F 1/10* (2006.01)

(52) U.S. Cl. ..... 270/45; 270/37; 270/58.07; 270/58.08

(58) Field of Classification Search ..... 270/32, 270/37, 45, 58.07, 58.08; 493/406, 407, 493/442, 454
See application file for complete search history.

(56) References Cited

U.S. PATENT DOCUMENTS

| | | | | |
|---|---|---|---|---|
| 6,692,208 | B1 | 2/2004 | Watkiss et al. | |
| 7,431,274 | B2 * | 10/2008 | Kushida et al. | 270/37 |
| 7,744,073 | B2 * | 6/2010 | Iguchi et al. | 270/32 |
| 8,109,495 | B2 * | 2/2012 | Kikkawa et al. | 270/45 |
| 2006/0263174 | A1 * | 11/2006 | Oikawa et al. | 412/33 |
| 2009/0057977 | A1 * | 3/2009 | Kawaguchi | 270/37 |
| 2012/0025439 | A1 * | 2/2012 | Yahata et al. | 270/58.07 |

* cited by examiner

*Primary Examiner* — Leslie A Nicholson, III
(74) *Attorney, Agent, or Firm* — Fitzpatrick, Cella, Harper & Scinto

(57) ABSTRACT

A sheet processing apparatus includes: a holding portion which holds a booklet containing a two-folded sheet; and a pressing portion which presses a spine of a booklet into shapes during movement along the spine of the booklet held by the holding portion. The pressing portion can decrease, or release a pressing force to be applied to the booklet spine within a predetermined area of a moving range in which the pressing roller moves along the booklet spine.

10 Claims, 18 Drawing Sheets

SHEET PROCESSING APPARATUS

BACKGROUND OF THE INVENTION

1. Field of the Invention

The present invention relates to a sheet processing apparatus and an image forming system having a pressing portion that presses a spine of a booklet to deform.

2. Description of the Related Art

Conventionally, when a sheet bundle including about 20 or more sheets is folded, a booklet is formed having a vicinity of a spine being curved. The folded state of the booklet including the sheet bundle folded as described above is insufficient, so that the booklet is soon opened even after it is folded. Therefore, the appearance is degraded. The booklet described above cannot lie flat, so that it is difficult to stack a great number of booklets. To solve this problem, the apparatus described in U.S. Pat. No. 6,692,208 is proposed.

The apparatus described in U.S. Pat. No. 6,692,208 includes a clamping jaw, a stop plate, and a pressing roller. The clamping jaw holds a booklet while it is folded. The stop plate can regulate the height of a booklet spine projecting from the clamping jaw. The pressing roller presses the booklet spine to deform. The apparatus flattens and squares the booklet spine. The apparatus solves the problem of the above-mentioned degraded appearance. Many booklets can be stably stacked.

In general, according to the conventional apparatus as described above, however, a pressing roller supported by a spring moves along the booklet spine. On the other hand, rigidity of the spine of the folded booklet depends on whether or not an image is formed on the spine, the rigidity of the spine is higher at a position where an image is formed. Therefore the spine of the folded booklet does not ensure uniform rigidity over the entire length. When the pressing roller moves on a rigid spine, the spine is insufficiently squared. When the pressing roller moves on a less rigid spine, the spine is squashed excessively.

Taking the above into consideration, the present invention provides a sheet processing apparatus capable of preventing from variability of an amount of squash to a booklet spine when the squaring is performed irrespectively of rigidity of the spine of a folded booklet.

SUMMARY OF THE INVENTION

A sheet processing apparatus includes: a holding portion which holds a booklet containing a two-folded sheet; and a pressing portion which presses to deform a spine of a booklet during movement along the spine of the booklet held by the holding portion. The pressing portion can decrease, or release a pressing force to be applied to the booklet spine within a predetermined area of a moving range in which the pressing roller moves along the booklet spine.

Further features of the present invention will become apparent from the following description of exemplary embodiments with reference to the attached drawings.

DESCRIPTION OF THE EMBODIMENTS

First Embodiment

Figure 1:
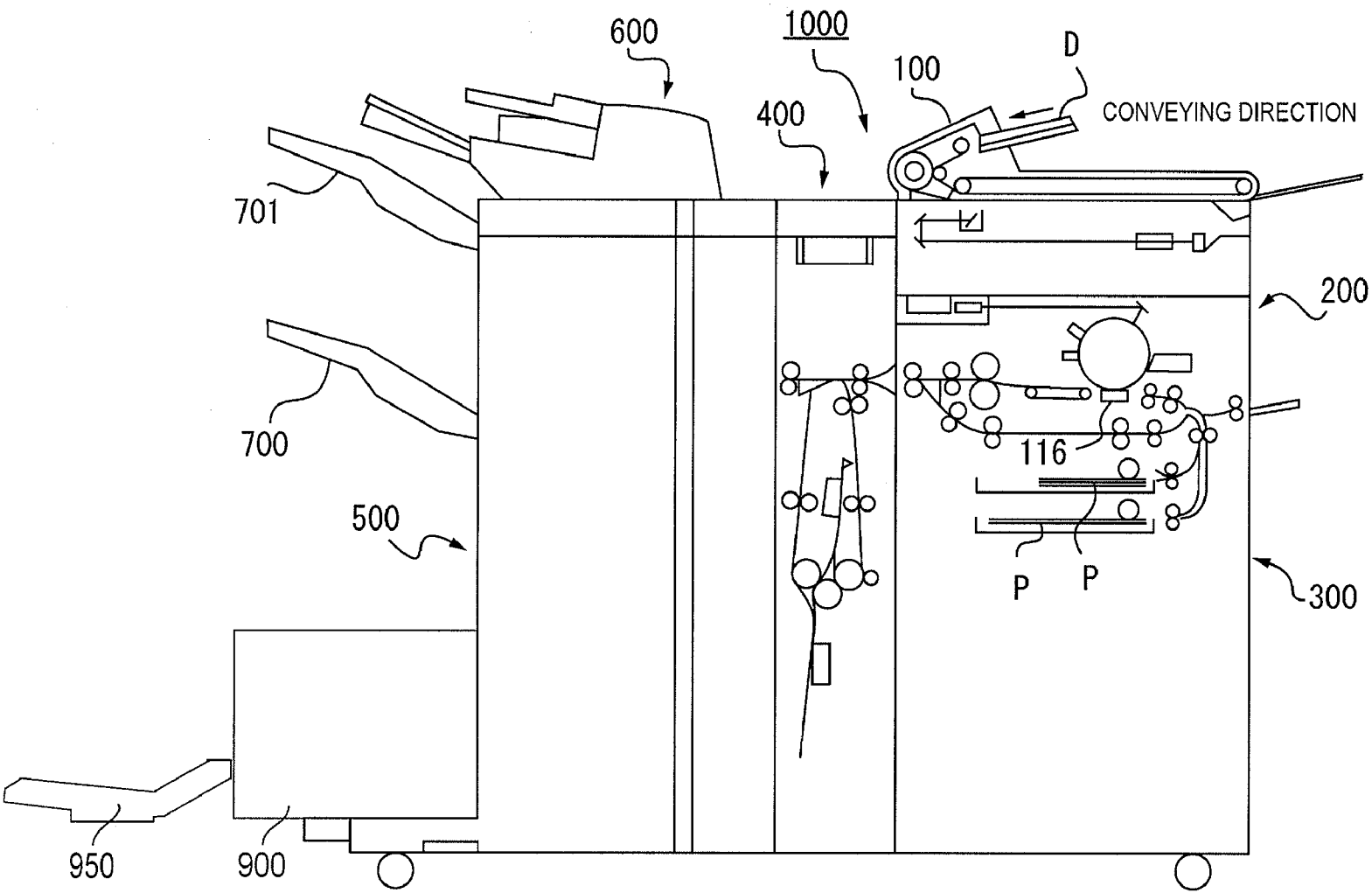
FIG. 1 is a sectional view which illustrates a configuration of a copier capable of using a sheet processing apparatus according to a first embodiment of the invention.

FIG. 1 is a sectional view which illustrates a configuration of an image forming system capable of using a sheet processing apparatus according to a first embodiment of the invention. As illustrated in FIG. 1, a copier 1000 as an image forming system includes a sheet supply portion 100, an image reader portion 200, a printer portion 300, a finisher 500, and a spine processing apparatus 900 (see FIG. 4). The finisher 500 and the spine processing apparatus 900 are available as options. Generally, an image forming apparatus for forming an image on a sheet includes at least the sheet supply portion 100, the image reader portion 200, and the printer portion 300.

The finisher 500 performs a sheet feeding process, a bundling process, and a stapling process (binding process). The sheet feeding process feeds a sheet where the printer portion 300 forms an image. The bundling process aligns and bundles multiple sheets being fed into one booklet. The stapling process staples a trailing edge of the finished sheet bundle. The finisher 500 also performs a punching process for punching the end of a sheet bundle from the face to the reverse side, a sort process, a non-sort process, and a saddle stitch binding process.

Figure 2:
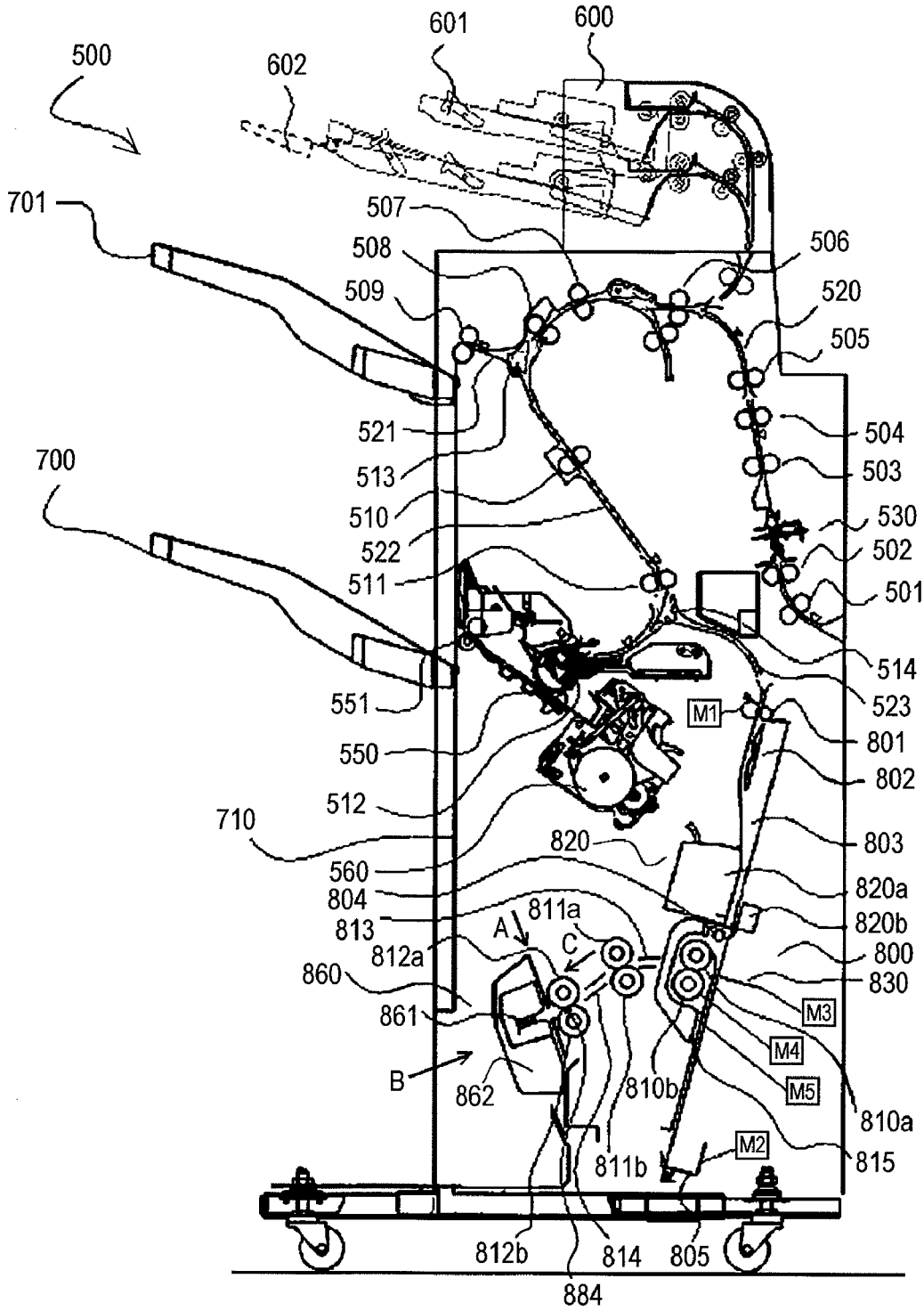
FIG. 2 is a sectional view of a configuration of a finisher.

FIG. 2 is a sectional view of a configuration of the finisher 500. The configuration of the finisher 500 will next be described along with a flow of sheets with reference to FIG. 2. As illustrated in FIG. 2, the finisher 500 has a conveying path 520 that takes the conveyed sheet into the apparatus from the printer portion 300. The conveying path 520 is provided with pairs of conveying rollers from a pair of inlet rollers 501 to a pair of inside rollers 508. Further, a punch unit 530 as a punch processing portion is arranged at a midpoint between pairs of conveying rollers 502 and 503. The punch unit 530 is driven according to need and punches a conveyed sheet at its trailing edge. A flapper 513 is provided at the end of the conveying path 520 downstream from the punch unit 530 in the conveying direction. The flapper 513, when operated, switches between an upper conveying path 521 and a lower conveying path 522 as sheet paths both connected downstream in the conveying direction. A sheet passes through the upper conveying path 521 and is discharged to a stack tray 701 by an upper discharge roller 509.

The lower conveying path 522 is provided with pairs of conveying rollers 510, 511, and 512. A sheet passing through the lower conveying path 522 is discharged to a process tray 550. Sheets discharged to the process tray 550 are sequentially aligned and bundled. The sheets are then sorted and stapled based on settings of an operation portion 1 (see FIG. 3). A pair of bundle discharge rollers 551 selectively discharges sheets to stack trays 700 and 701.

A stapler 560 performs the above-mentioned stapling process. The stapler 560 is movable in the width direction of a sheet and is capable of stapling at any position of the sheet. The stack trays 700 and 701 are movable vertically. The upper stack tray 701 can receive sheets from the upper conveying path 521 and the process tray 550. The lower stack tray 700 can receive sheets from the process tray 550. The stack trays 700 and 701 can mount a large number of sheets. A vertically extending trailing edge guide 710 regulates and aligns the trailing edge of the mounted sheets.

Next, a configuration of a saddle stitch binding portion 800 will be described. A switching flapper 514 is arranged at a midpoint of the lower conveying path 522. The switching flapper 514 guides a sheet to the bottom right of the finisher 500 in FIG. 2. The sheet passes through a saddle discharge path 523 and is sent to the saddle stitch binding portion 800. A pair of saddle inlet rollers 801 receives the sheet. A flapper 802 is operated by a solenoid according to sheet sizes and selects a carry-in port accordingly. The sheet is carried into an accommodating guide 803 of the saddle stitch binding portion 800 through the selected carry-in port. The carried sheet is conveyed by a slide roller 804 until the leading end of the sheet is brought into contact with a movable sheet positioning member 805. A motor M1 drives the pair of saddle inlet rollers 801 and the slide roller 804.

A stapler 820 is provided at the middle of the accommodating guide 803 so as to be arranged across the accommodating guide 803. The stapler 820 is divided into a driver 820*a* that projects staples and an anvil 820*b* that bends the projected staples. The sheet positioning member 805 stops at the portion where the central portion of the sheet in the sheet conveying direction is located at the binding position of the stapler 820, when the sheet is conveyed. The sheet positioning member 805 is movable through the drive of a motor M2, and changes its position according to a sheet size.

A pair of folding rollers 810*a* and 810*b* is provided at the downstream side of the stapler 820. A projecting member 830 is provided at the position opposite to the pair of folding rollers 810*a* and 810*b*. The position where the projecting member 830 retracts from the accommodating guide 803 is specified as a home position. The projecting member 830, driven by a motor M3, projects toward an accommodated sheet bundle and folds it while pressing it into a nip between the pair of folding rollers 810*a* and 810*b*. Thereafter, the projecting member 830 returns again to the home position. A spring (not illustrated) applies pressure F1 sufficient for folding the sheet bundle between the pair of folding rollers 810*a* and 810*b*. The folded sheet bundle passes through a pair of first fold and conveying rollers 811*a* and 811*b*, a pair of second fold and conveying rollers 812*a* and 812*b*, and is discharged to the spine processing apparatus 900 (see FIG. 1). Pressures F2 and F3 sufficient for conveying and stopping the folded sheet bundle are also applied to the pair of first fold and conveying rollers 811*a* and 811*b* and the pair of second fold and conveying rollers 812*a* and 812*b*.

A conveying guide 813 connects between a pair of folding rollers 810*a* and 810*b* and the pair of first fold and conveying rollers 811*a* and 811*b*. A conveying guide 814 connects between the pair of first fold and conveying rollers 811*a* and 811*b* and the pair of second fold and conveying rollers 812*a* and 812*b*. The same motor M4 (not illustrated) rotates the pair of folding rollers 810*a* and 810*b*, the pair of first fold and conveying rollers 811*a* and 811*b*, and the pair of second fold and conveying rollers 812*a* and 812*b* at a constant speed.

After the stapling process is completed, the stapling position of the sheet bundle is adjusted to the nip position between the pair of folding rollers 810*a* and 810*b*. From the position settled on completion of the stapling process, the sheet positioning member 805 lowers for a predetermined distance to fold the sheet bundle stapled by the stapler 820. With this process, the sheet bundle can be folded with the position where the stapling process is performed.

A pair of aligning plates 815 surrounds the outer periphery of the pair of folding rollers 810*a* and 810*b*, and has a surface projecting to the accommodating guide 803. The pair of aligning plates 815 aligns sheets placed in the accommodating guide 803. The pair of aligning plates 815 is driven by a motor M5 and moves in the direction of catching a sheet to position the sheet in the width direction thereof.

A fold pressing unit 860 is provided downstream of the pair of second fold and conveying rollers 812*a* and 812*b* so as to spatially overlap with a fold discharge tray. The fold pressing unit 860 has a pressing holder 862 which supports a pair of pressing rollers 861. While the pair of pressing rollers 861 nips the fold, the fold pressing unit 860 moves the pressing holder 862 in the folding direction to reinforce the fold.

Figure 3:
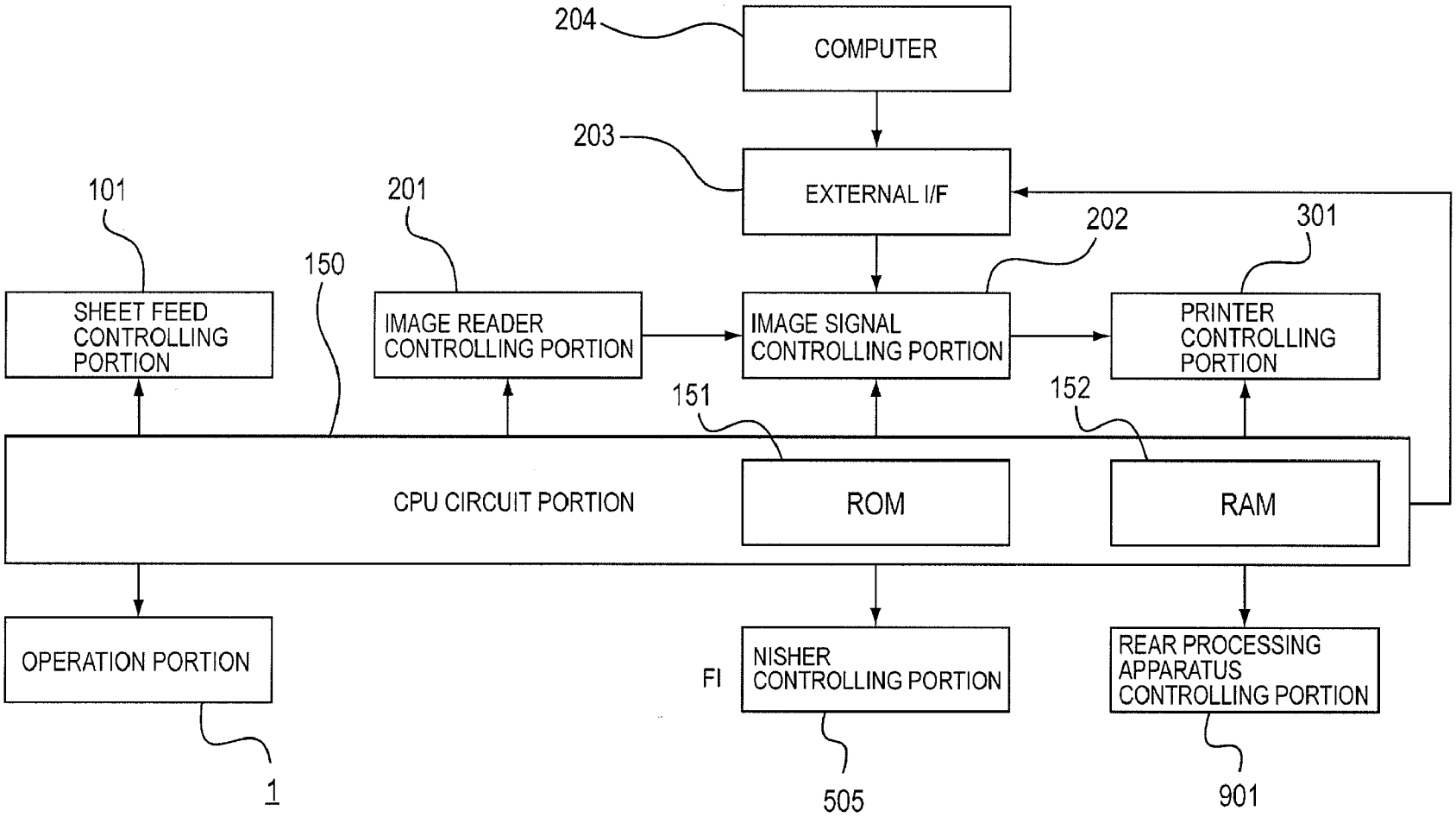
FIG. 3 is a block diagram illustrating the copier.

FIG. 3 is a block diagram illustrating a copier 1000. As illustrated in FIG. 3, a CPU circuit portion 150 inside the copier 1000 includes a CPU (not illustrated). The CPU circuit portion 150 controls controlling portions according to a control program stored in a ROM 151 and settings on the operation portion 1. Namely, the CPU circuit portion 150 controls the operation portion 1, a sheet feed controlling portion 101, an image reader controlling portion 201, an image signal controlling portion 202, a printer controlling portion 301, a finisher controlling portion 505, a spine processing apparatus controlling portion 901, and an external I/F 203.

The sheet feed controlling portion 101 controls the sheet supply portion 100. The image reader controlling portion 201 controls the image reader portion 200. The printer controlling portion 301 controls the printer portion 300. The finisher controlling portion 505 controls the finisher 500 and the saddle stitch binding portion 800. The spine processing apparatus controlling portion 901 controls the spine processing apparatus 900.

The operation portion 1 has plural keys for setting various functions relating to the image formation, and a display portion for displaying the setting state. The operation portion 1 outputs a key signal corresponding to the user's key operation to the CPU circuit portion 150. Based on a signal from the CPU circuit portion 150, the operation portion 1 displays related information on a display portion.

The RAM 152 is used as an area for temporarily retaining the control data or as a working area for computation involved with the control. The external I/F (external interface) 203 is an interface between the copier 1000 and an external computer 204. It expands the print data from the computer 204 into a bit-mapped image, and outputs the resultant to the image signal controlling portion 202 as image data. The image reader controlling portion 201 outputs the image of the sheet read by an image sensor (not illustrated) to the image signal controlling portion 202. The printer controlling portion 301 outputs the image data from the image signal controlling portion 202 to an exposure controlling portion (not illustrated).

Figure 4:
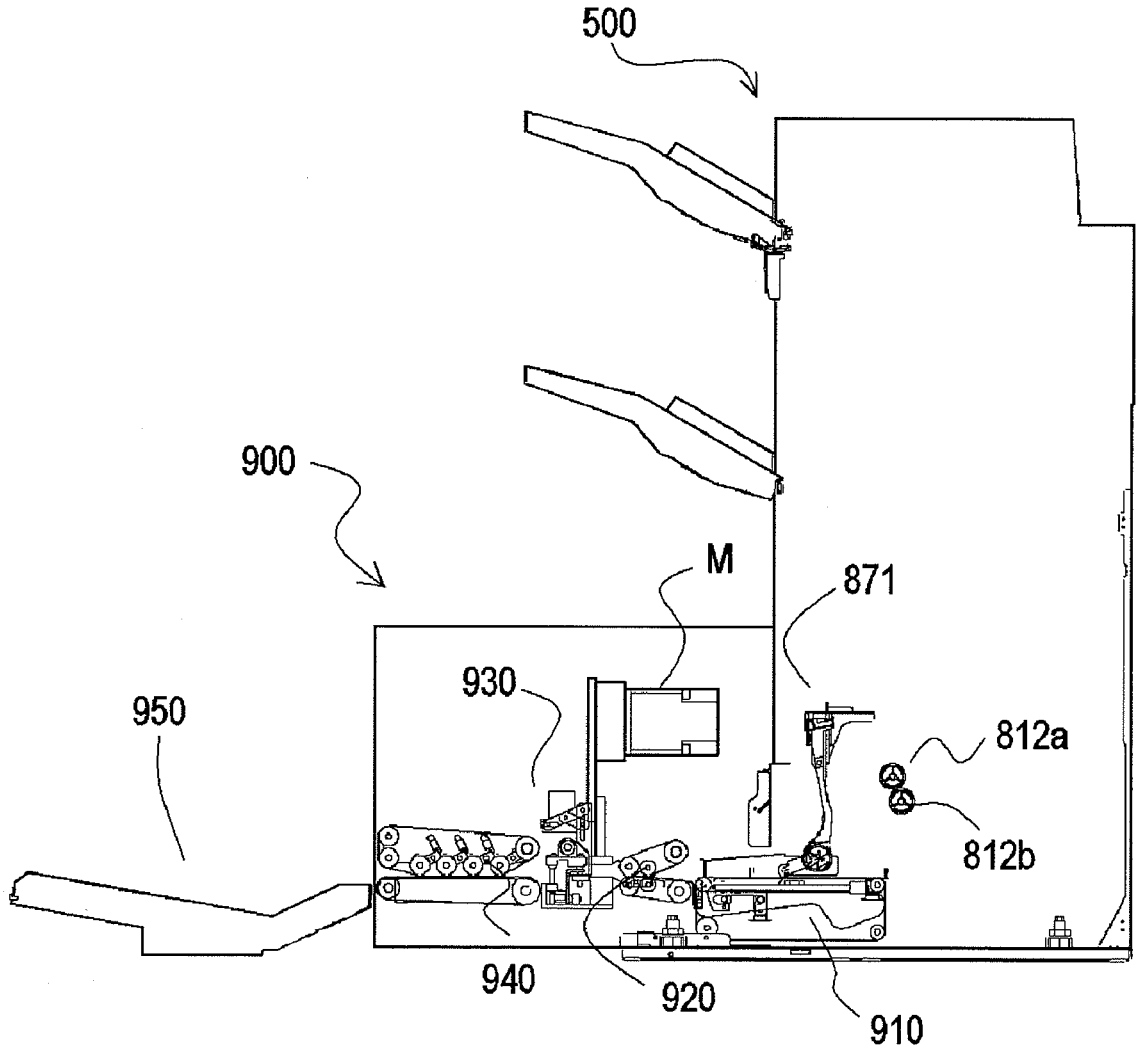
FIG. 4 is a sectional view illustrating a configuration of a spine processing apparatus.

FIG. 4 is a sectional view illustrating a configuration of the spine processing apparatus 900. As illustrated in FIG. 4, the booklet as a sheet bundle is discharged from the pair of second fold and conveying rollers 812*a* and 812*b* included in the saddle stitch binding portion 800. While a bundle presser 871 prevents the booklet from swelling, the booklet is discharged onto a receiving unit 910. A spine processing unit 930 squashes the spine of the booklet conveyed by the receiving unit 910 and a pair of conveying belts 920. The booklet is then passed to a pair of discharge belts 940 and then is placed on a tray 950.

Figure 5B:
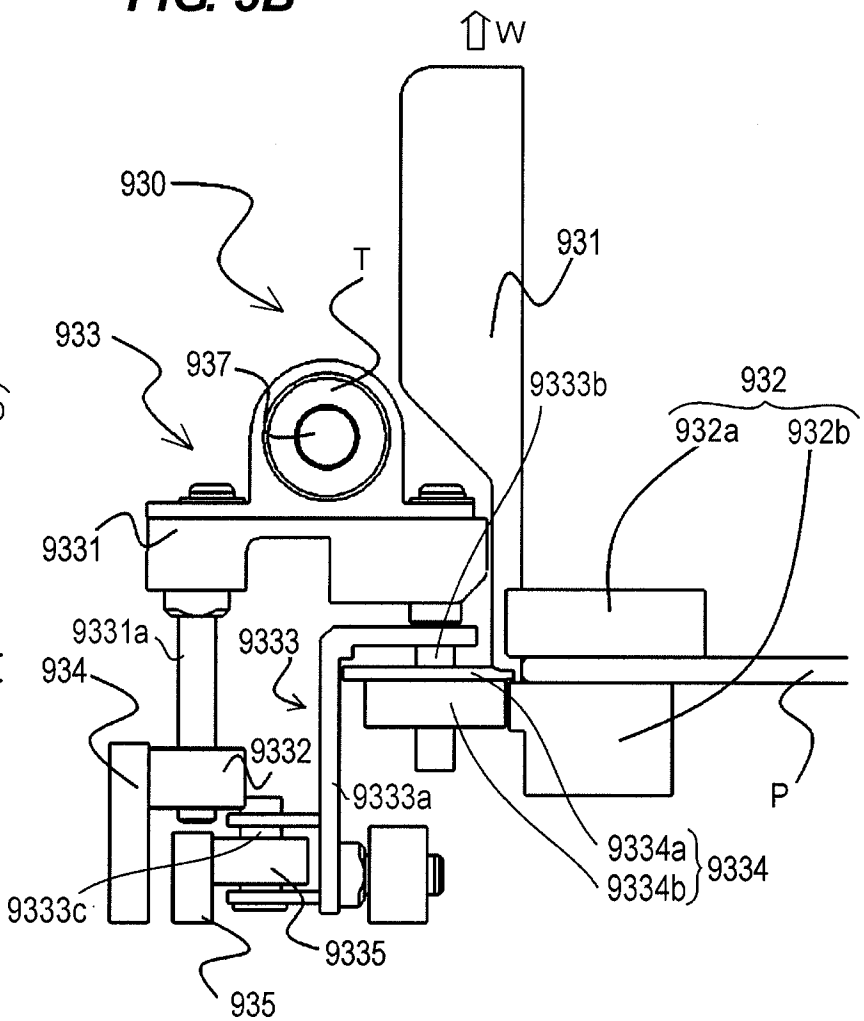
FIG. 5 is a partially enlarged sectional view illustrating the configuration of the spine processing apparatus.
Figure 5A:
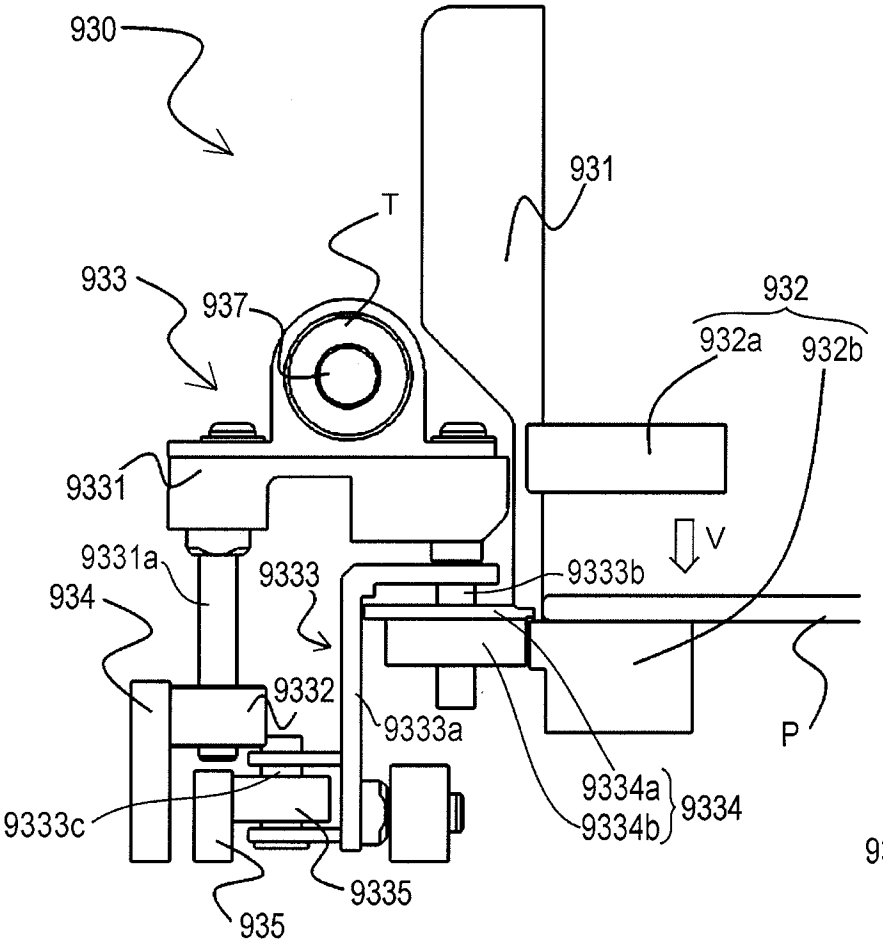
Figure 6B:
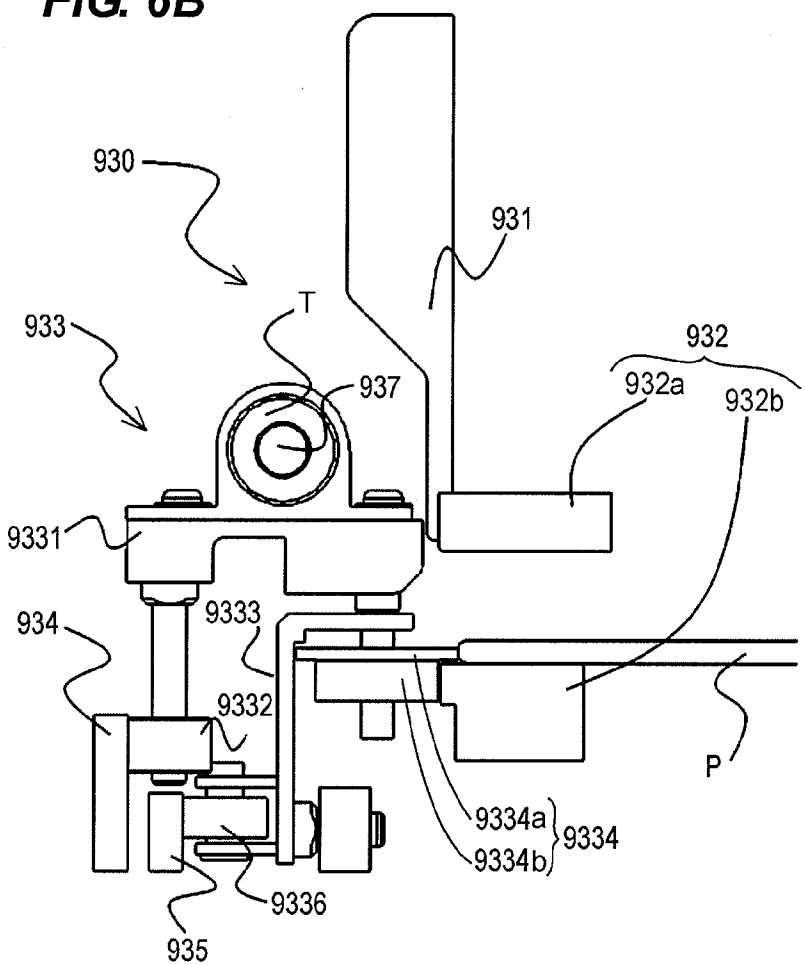
FIG. 6 is a partially enlarged sectional view illustrating the configuration of the spine processing apparatus.
Figure 6A:
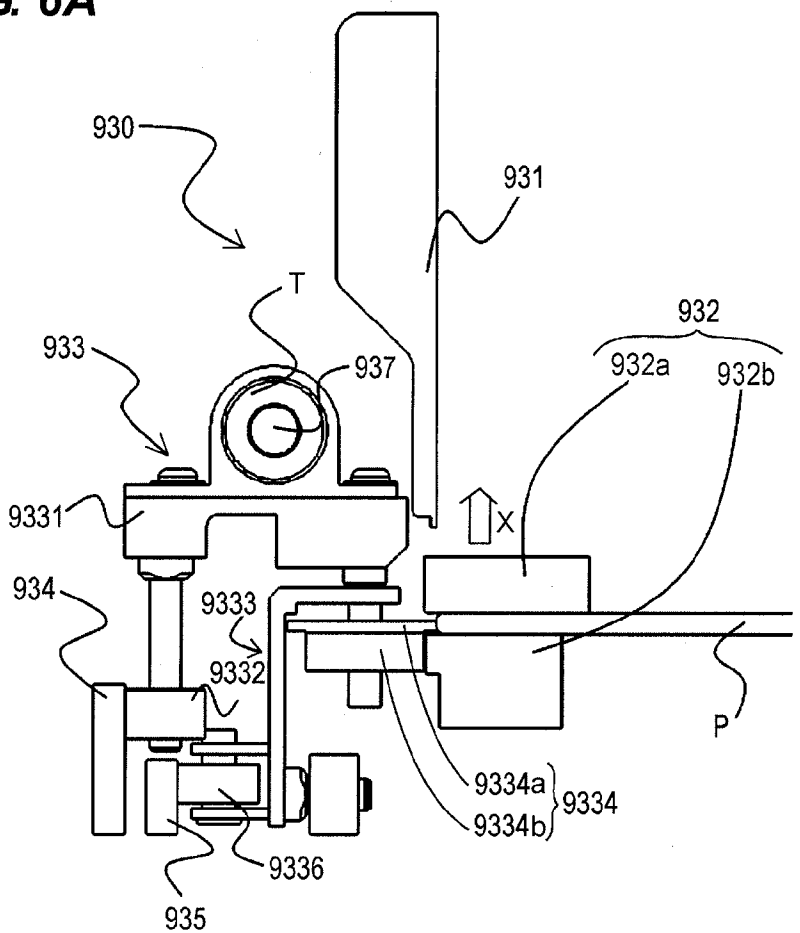

FIG. 5 is a partially enlarged sectional view illustrating the configuration of the spine processing unit 930 included in the spine processing apparatus 900. FIG. 5A is a partially enlarged sectional view illustrating a process of the spine processing unit 930 immediately before a moving portion 932*a* lowers. FIG. 5B is a partially enlarged sectional view illustrating a process of the spine processing unit 930 immediately before a stopper member 931 rises. FIG. 6 is a partially enlarged sectional view illustrating the configuration of the spine processing unit 930. FIG. 6A is a partially enlarged sectional view illustrating a process of the spine processing unit 930 immediately before the moving portion 932*a* is elevated. FIG. 6B is a partially enlarged sectional view illustrating a process of the spine processing unit 930 immediately after the moving portion 932*a* finishes rising. As illustrated in FIG. 5, the spine processing apparatus 900 may include the pair of conveying belts 920 as described with reference to FIG. 4. The spine processing apparatus 900 mainly includes a moving unit 933, a holding portion 932, a stopper member 931, a moving unit supporting plate 934, and a press unit supporting plate 935.

The holding portion 932 holds a booklet P. To be more specific, the holding portion 932 holds the booklet P as a sheet bundle equivalent to one or more folded sheets in two. The holding portion 932 includes the moving portion 932*a* and a static portion 932*b*. The surface of the static portion 932*b* is almost level with the pair of conveying belts 920 as the nip. The booklet P passes through the pair of conveying belts 920 and is guided onto the static portion 932*b*. The moving portion 932*a* is vertically movable so that a distance between the moving portion 932*a* and the static portion 932*b* can be adjusted. According to this configuration, the booklet P is guided onto the static portion 932*b*. The moving portion 932*a* then lowers to maintain the position of the booklet P.

The stopper member 931 prevents the conveyed booklet P from moving in the sheet conveying direction. As illustrated in FIG. 5A, the stopper member 931 can lower on the static portion 932*b* to stop the booklet P from traveling. In this state, the booklet P enters the holding portion 932 and comes to a stop against the stopper member 931. According to this configuration, the spine of the booklet P is positioned on the static portion 932*b* of the holding portion 932.

The moving unit 933 includes a slide shaft 937, a slide bearing T, a slide portion 9331, a shaft 9331*a*, and a roller 9332. The moving unit 933 moves in the sheet width direction orthogonal to the sheet conveying direction. The slide shaft 937 extends in the sheet width direction orthogonal to the sheet conveying direction. The slide shaft 937 is provided with the slide bearing T. The slide bearing T is provided with the slide portion 9331. The vertically extending shaft 9331*a* is fixed to the slide portion 9331. The roller 9332 is rotatably attached to the shaft 9331*a*. The moving unit supporting plate 934 is provided so as to extend in the sheet width direction orthogonal to the sheet conveying direction through a position opposite to the roller 9332. The slide portion 9331 and the slide bearing T can move along the slide shaft 937. The moving unit 933 includes a press unit 9333.

The press unit 9333 includes a roller support member 9333*a*, a shaft 9333*b*, a shaft 9333*c*, a pressing roller 9334 as a pressing portion, and a roller 9335. The shaft 9333*b* vertically extends upstream of the roller support member 9333*a* in the sheet conveying direction. The shaft 9333*c* vertically extends downstream of the roller support member 9333*a* in the sheet conveying direction. The pressing roller 9334 is rotatably attached to the shaft 9333*b*. The roller 9335 is rotatably attached to the shaft 9333*c*. The press unit supporting plate 935 is provided so as to extend in the sheet width direction orthogonal to the sheet conveying direction through a position opposite to the roller 9335.

When the roller support member 9333*a* moves in the sheet width direction orthogonal to the sheet conveying direction, the roller 9335 moves along the press unit supporting plate 935. The pressing roller 9334 also moves along the spine of the booklet P. During movement along the spine of the booklet P held by the holding portion 932, the pressing roller 9334 presses the spine of the booklet P into shapes. The pressing roller 9334 includes a pressing member 9334*a* and a positioning rotating member 9334*b*. The pressing member 9334*a* presses the spine of the booklet P. The positioning rotating member 9334*b* abuts the static portion 932*b*.

According to operations of the moving unit 933 and the press unit 9333 as described above, the spine processing apparatus 900 is capable of post-processing for the spine of the booklet P positioned by the holding portion 932 and the stopper member 931.

Operations of the spine processing unit 930 and conveying operations for the booklet P will be described as follows. The booklet P contains multiple sheets discharged from the image forming apparatus. The finisher 500 as a sheet bookbinding apparatus staples and folds the booklet P. The spine processing unit 930 receives the booklet P from the finisher 500. As illustrated in FIG. 5A, the booklet P is guided on the static portion 932*b* of the holding portion 932 and abuts the stopper member 931 for positioning. The moving portion 932*a* of the holding portion 932 is driven by a motor (not illustrated) and starts lowering in the direction indicated by an arrow V. As illustrated in FIG. 5B, the moving portion 932*a* and the static portion 932*b* of the holding portion nip the booklet P. The stopper member 931 is then driven by a motor (not illustrated) and starts rising in the direction indicated by an arrow W. After the stopper member 931 rises, as illustrated in FIG. 6A, operations of the moving unit 933 and the press unit 9333 allow the pressing member 9334*a* of the pressing roller 9334 to start pressing the spine of the booklet P. At that time, the moving unit 933 squares the spine of the booklet P. When the squaring is completed, the moving portion 932*a* is driven by a motor (not illustrated) and again starts rising in a direction indicated by an arrow X. This operation allows the holding portion 932 to release the booklet P. As illustrated in FIG. 6B, the spine processing unit 930 stops driving when the moving portion 932*a* finishes rising.

Figure 7:
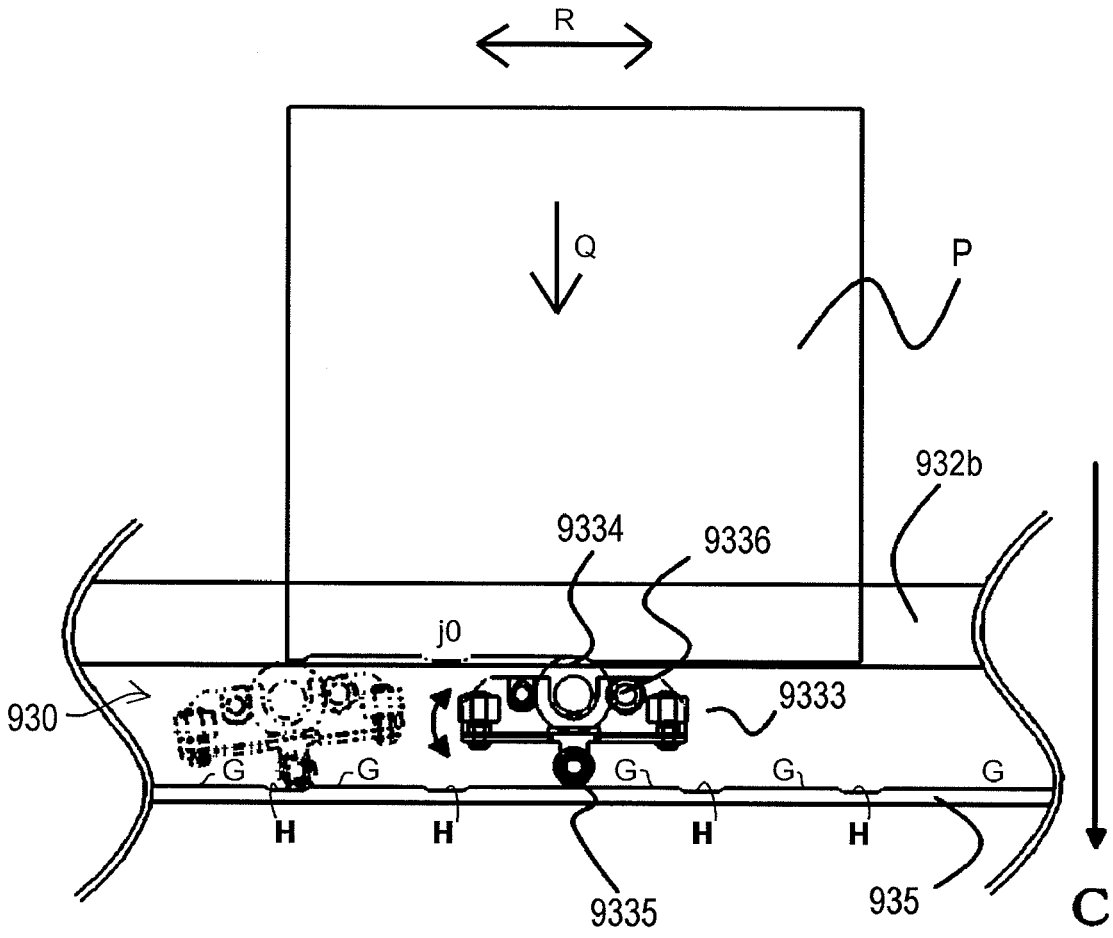
FIG. 7 is a plane view illustrating a configuration of a press unit.

FIG. 7 is a plane view illustrating a configuration of the press unit 9333. As illustrated in FIG. 7, the press unit 9333 can move in a sheet width direction R orthogonal to a sheet conveying direction Q. The press unit 9333 includes the pressing roller 9334 and the roller 9335. The pressing member 9334*a* (see FIGS. 5 and 6) of the pressing roller 9334 abuts the spine of the booklet P. The roller 9335 abuts the press unit supporting plate 935 as a guide portion. The press unit 9333 has two rocking shafts 9336 and can rock around the rocking shafts 9336. According to this support configuration of the press unit 9333, the pressing member 9334*a* supported by the press unit supporting plate 935 can apply a predetermined amount of squash to the spine of the booklet P even though the spine thereof does not ensure uniform rigidity.

The pressing roller 9334 moves from the home position and ascends one end of the spine of the booklet P. At that time, a shock is applied to excessively squash the end of the spine. Such excessive squash hardly occurs at the other end of the booklet spine where the pressing roller descends. Both ends of the booklet spine are unevenly squashed, thus degrading the quality of the bound product.

To solve this problem, the press unit supporting plate 935 as a guide portion includes a recessed portion H as a retract portion and a projected portion G as a pushing portion and guides the movement of the pressing roller 9334. The retract portion and the pushing portion move the pressing portion position. Moving the roller 9335 on the surface of the projected portion G causes the pressing roller 9334 to apply a larger pressing force to the spine of the booklet P than moving the roller 9335 in the recessed portion H. The pressing roller 9334 can decrease, or release the pressing force to be applied to the spine of the booklet P within a predetermined area of the moving range in which the pressing roller 9334 moves along the spine of the booklet P. The pressing force decreases when the roller 9335 enters the recessed portion H formed in the press unit supporting plate 935 and allows the pressing roller 9334 to retract in the direction of an arrow C (the reverse direction to the pressing direction). The depth of the recessed portion H determines the amount of retraction (the direction of the arrow C) for the pressing roller 9334. The pressing force increases when the roller 9335 is placed on the surface of the projected portion G formed on the press unit supporting plate 935 and allows the pressing roller 9334 to be pushed in the reverse direction of the arrow C (the pressing direction). The height of the projected portion G determines the amount of pushing (the reverse direction of the arrow C) for the pressing roller 9334. And that is, the press unit supporting plate 935 guides the pressing roller 9334 in a direction along the spine of the booklet P at a predetermined distance from the spine of the booklet P and guides the pressing roller 9334 further away from the spine of the booklet P within a predetermined area of a moving range in which the pressing roller 9334 moves along the spine of the booklet P.

The press unit 9333 rocks around either rocking shaft 9336 when the press unit 9333 passes through the projected portion G and enters the recessed portion H and when it passes through the recessed portion H and exits to the projected portion G. A press unit supporting plate 935 regulates the rocking range via the roller 9335.

The range located on one end portion of the spine of the booklet P when the pressing roller 9334 starts pressing the spine of the booklet P determines the above-mentioned predetermined area of the moving range where the pressing roller 9334 moves. When the booklet P is stapled and the staple is exposed on the spine of the booklet P, a range j0 for the staple determines that predetermined area of the moving range for the pressing roller 9334 to move. When the staple is exposed on the spine of the booklet P, that predetermined area of the moving range for the pressing roller 9334 to move is located on a line containing the staple. When the staple supplied from the stapler is exposed on the spine of the booklet P, the pressing roller 9334 passes through the staple on the booklet spine and bends the staple, thus degrading the quality of the bound product. The booklet can be stapled so that the direction of the staple end is aligned with the thickness direction of the booklet spine. Depending on booklet conditions, however, the direction of the staple end might slightly vary to bend the staple.

It is supposed that the spine of the booklet P is aligned with the side of the static portion 932*b*. When the pressing roller 9334 passes through both ends of the spine of the booklet P and the staple, the pressing roller 9334 preferably retracts in the direction of the arrow C so as not to exceed the line of the static portion 932*b*. That is, the pressing roller 9334 does not retract from the line of the static portion 932*b* in the direction of the arrow C. In this manner, this can prevent the staple from being squashed and bent excessively and ensure proper squaring. For example, it is supposed that the booklet P contains 25 sheets each of which weighs 64 g/m$^2$. Basically, the pressing roller 9334 travels by keeping the depth of 1.5 mm from the spine top of the booklet P in the reverse direction of the arrow C. When passing through both ends of the spine of the booklet P and the staple, the pressing roller 9334 travels by keeping the depth of 0.5 mm from the spine top thereof in the reverse direction of the arrow C. Of course, these values are only examples and may be otherwise specified according to the scope of the present invention.

Figure 8:
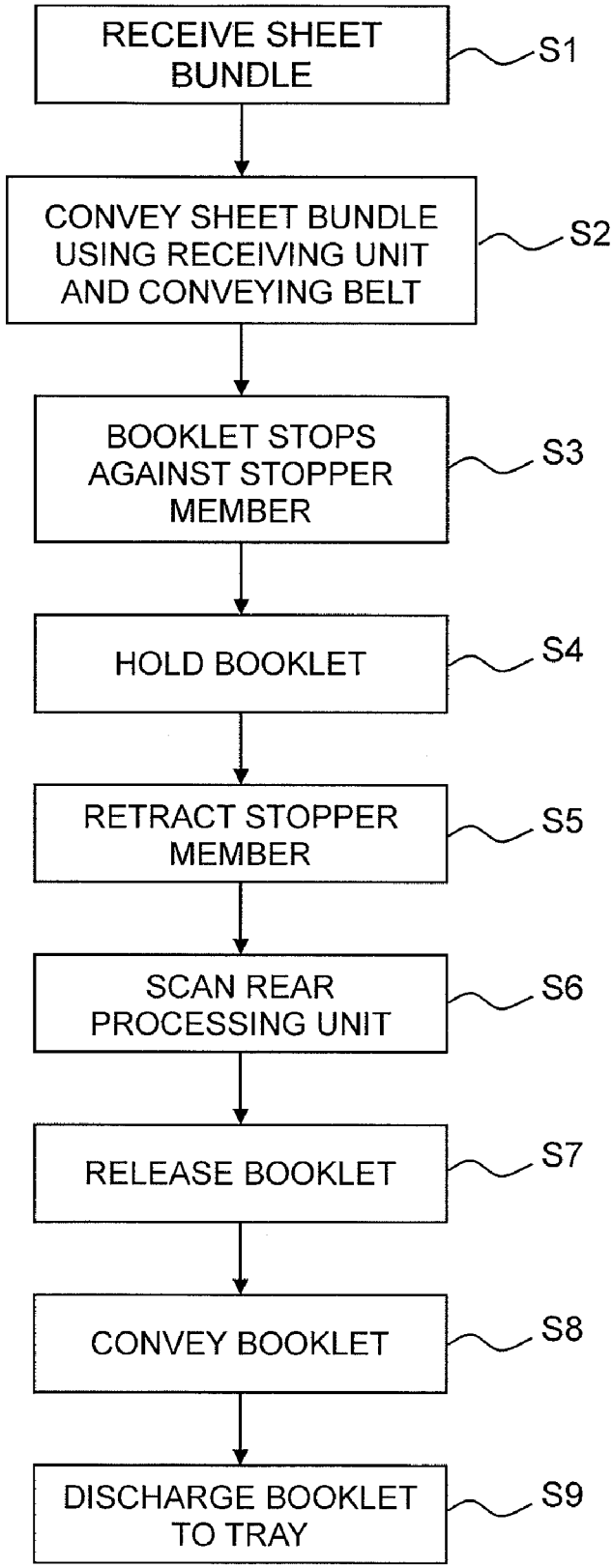
FIG. 8 is a flowchart illustrating a control process of a CPU circuit portion.

FIG. 8 is a flowchart illustrating a control process of the CPU circuit portion 150. As illustrated in FIG. 8, the CPU circuit portion 150 allows the receiving unit 910 to receive the booklet P (S1). The CPU circuit portion 150 allows the receiving unit 910 and the pair of conveying belts 920 to convey the booklet P (S2). The CPU circuit portion 150 uses a sensor (not illustrated) to detect that the booklet P abuts the stopper member 931. The CPU circuit portion 150 makes the moving portion 932*a* of the holding portion 932 ready for driving (S3). The CPU circuit portion 150 lowers the moving portion 932*a* of the holding portion 932 to hold the booklet P (S4). The CPU circuit portion 150 retracts the stopper member 931 (S5). The CPU circuit portion 150 drives the press unit 9333 to process the spine of the booklet P (S6). The CPU circuit portion 150 retracts the moving portion 932*a* of the holding portion 932 to release the booklet P (S7). The CPU circuit portion 150 drives the pair of discharge belts 940 to convey the booklet P (S8). The CPU circuit portion 150 discharges the booklet P to the tray 950 (S9).

Second Embodiment

Figure 9:
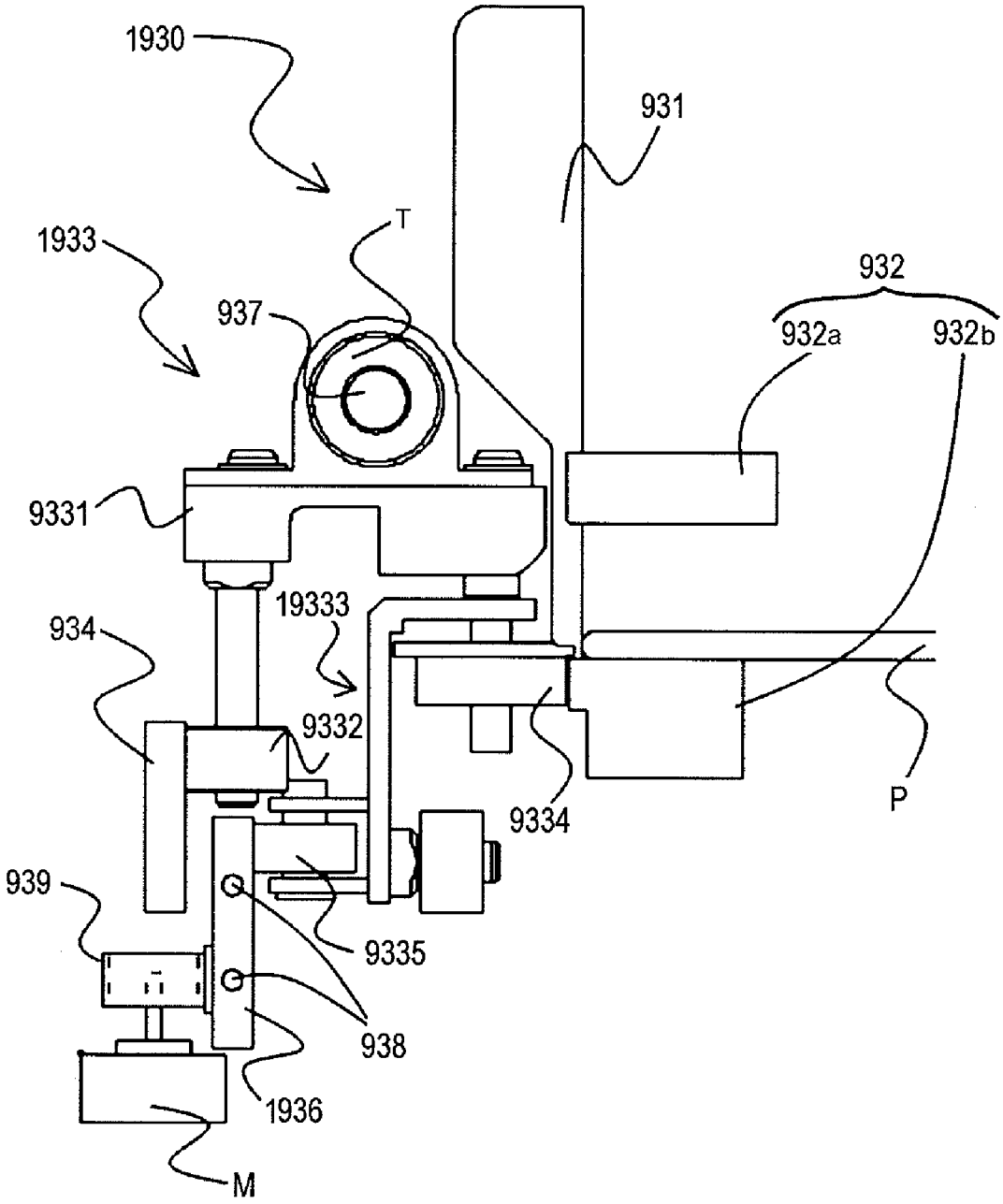
FIG. 9 is a partially enlarged sectional view illustrating a configuration of a spine processing unit used for an image forming apparatus according to a second embodiment of the invention.
Figure 10A:
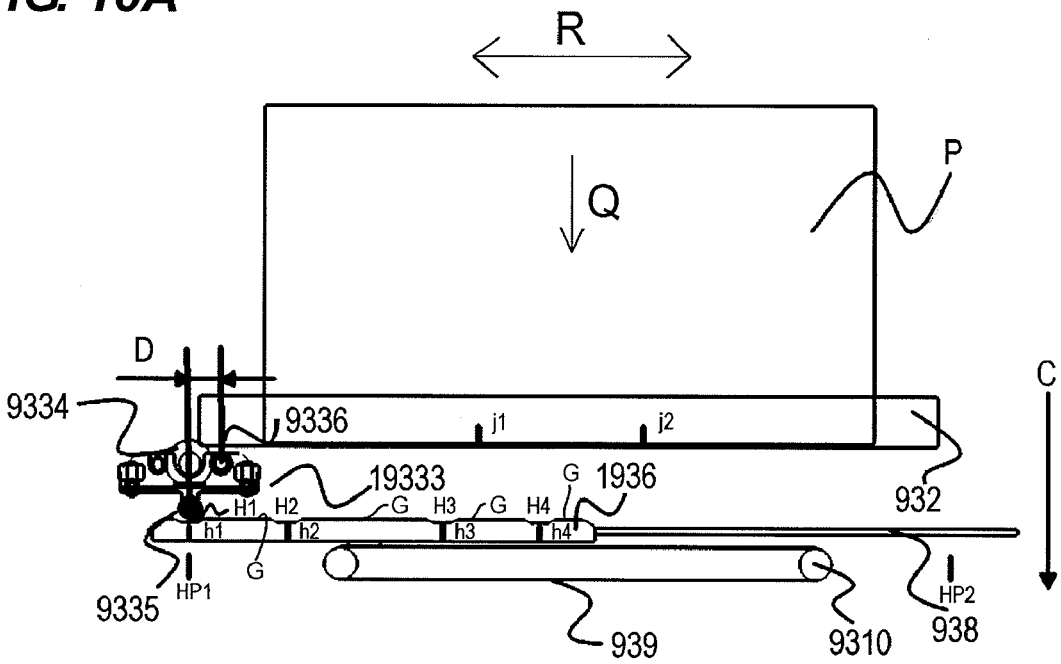
FIG. 10 is a plane view illustrating a configuration of the press unit.
Figure 10B:
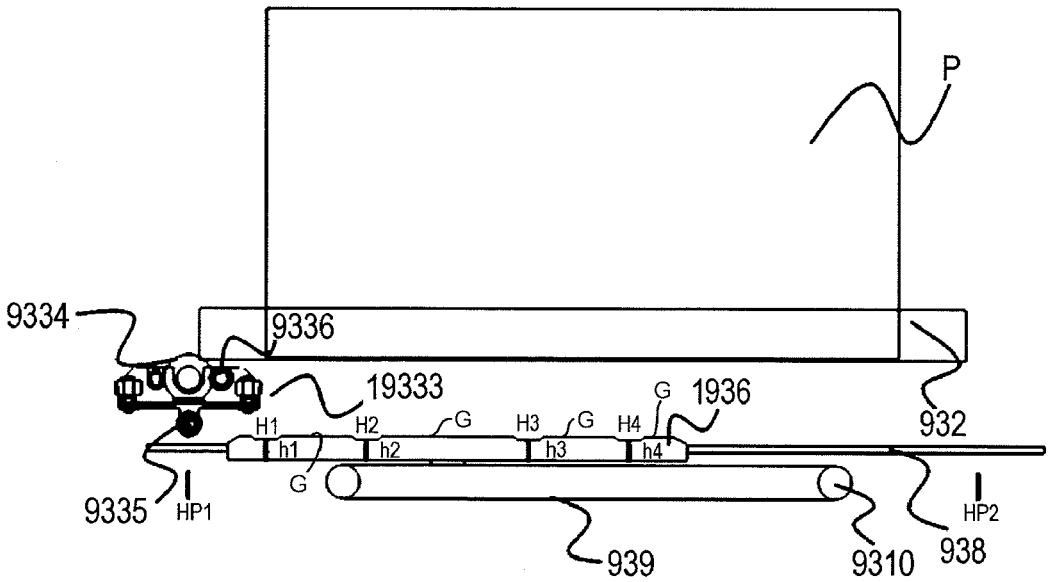

FIG. 9 is a partially enlarged sectional view illustrating a configuration of a spine processing unit 1930 used for an image forming apparatus according to a second embodiment of the inventions. FIG. 10 includes FIGS. 10A and 10B and provides a plane view illustrating a configuration of a press unit 19333. The mutually corresponding components and effects in the configuration of the spine processing apparatus according to the second embodiment and the configuration of the spine processing apparatus 900 according to the first embodiment are depicted by the same reference numerals and a detailed description is not described for simplicity. The second embodiment is also applicable to the image forming apparatus according to the first embodiment and the description of the image forming apparatus will not be repeated. The spine processing unit 1930 according to the second embodiment differs from the spine processing unit 930 according to the first embodiment as follows. As illustrated in FIGS. 9 and 10, the spine processing apparatus according to the second embodiment includes a moving portion which moves the press unit supporting plate 1936 as the guide portion in the direction parallel to the spine of the booklet P. The moving portion includes a moving belt 939, a pulley 9310 (see FIG. 10), and a supporting plate shaft 938. Recessed portions H1 through H4 and the projected portion G move parallel to the spine of the booklet P while the press unit supporting plate 1936 moves based on the drive of the moving belt 939.

The press unit supporting plate 1936 includes the recessed portion H1 through H4 and the projected portion G and guides the movement of the pressing roller 9334. When moving along the spine of the booklet P, the pressing roller 9334 moves in the recessed portions H1 through H4 to decrease a pressing force applied to the spine of the booklet P. The pressing roller 9334 moves on the surface of the projected portion G to increase a pressing force applied to the spine of the booklet P.

As illustrated in FIG. 10A, the press unit 19333 includes the pressing roller 9334, and the roller 9335. The press unit 19333 includes the rocking shaft 9336 and can rock around it. The press unit supporting plate 1936 regulates the rocking through the roller 9335. The press unit supporting plate 1936 has the recessed portions H1 through H4 and recessed portion centers h1 through h4 as references at the centers of the recessed portions H1 through H4. The recessed portions H1 through H4 allow the pressing roller 9334 to retract in the direction of the arrow C.

The press unit 19333 includes the supporting plate shaft 938 extending in the sheet width direction R orthogonal to the sheet conveying direction Q. The press unit supporting plate 1936 can move along the supporting plate shaft 938. The moving belt 939 (see FIG. 9) is fixed to the press unit supporting plate 1936. A stepping motor M rotates the moving belt 939 through the pulley 9310 so as to be able to slide the press unit supporting plate 1936 along the supporting plate shaft 938. The slide movement changes the position for retracting the press unit 19333.

The press unit 19333 uses a center shaft of the pressing roller 9334 as a reference. The press unit supporting plate 1936 uses the recessed portion center h1 of the recessed portion H1 as a reference. The press unit 19333 and the press unit supporting plate 1936 start from a first home position HP1. The stepping motor M (not illustrated in terms of retract unit driving) drives the press unit 19333 and the press unit supporting plate 1936. A rotating speed is used to detect positions of the press unit 19333 and the press unit supporting plate 1936.

The recessed portions H2, H3, and H4 are provided at predetermined positions with reference to the recessed portion H1. An interval between the recessed portions H2 and H3 equals to an interval between staples j1 and j2 of the booklet P. Accordingly, detecting the position of the recessed portion H1 can also detect positions of the recessed portions H2, H3, and H4.

FIGS. 11, 12, 13, and 14 are plane views illustrating configurations of the press unit 19333. FIG. 15 is a flowchart illustrating a control process of the CPU circuit portion 150. Operations of the spine processing apparatus will be described with reference to these drawings along with FIG. 10 as described above.

As illustrated in FIG. 10A, the CPU circuit portion 150 allows the press unit 19333 and the press unit supporting plate 1936 to wait at the first home position HP1 (step 1 or as hereinafter referred to S1 in FIG. 15). The CPU circuit portion 150 receives size information about the booklet P from the RAM 152 of the copier (S2 in FIG. 15). The CPU circuit portion 150 moves the press unit supporting plate 1936 toward a second home position HP2 (S3 in FIG. 15). As illustrated in FIG. 10B, the CPU circuit portion 150 determines whether the recessed portion center h1 of the recessed portion H1 on the press unit supporting plate 1936 reaches one end of the spine of the booklet P (S4 in FIG. 15). When the determination results in YES, the CPU circuit portion 150 stops the press unit supporting plate 1936 at that position (S5 in FIG. 15). When the determination results in NO, the processing returns to S3 in control of the CPU circuit portion 150.

Figure 11A:
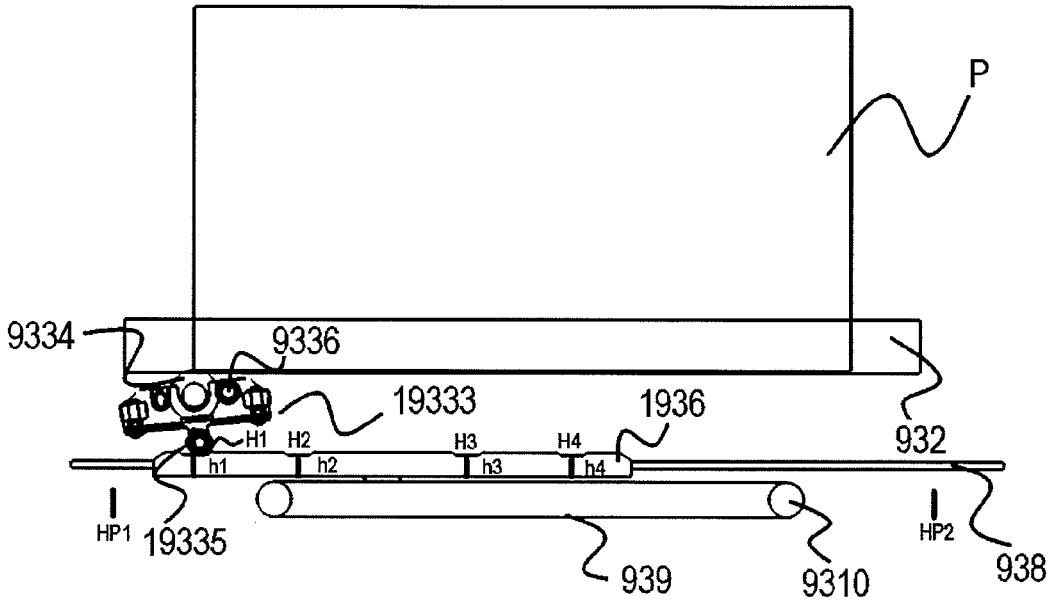
FIG. 11 is a plane view illustrating a configuration of the press unit.
Figure 11B:
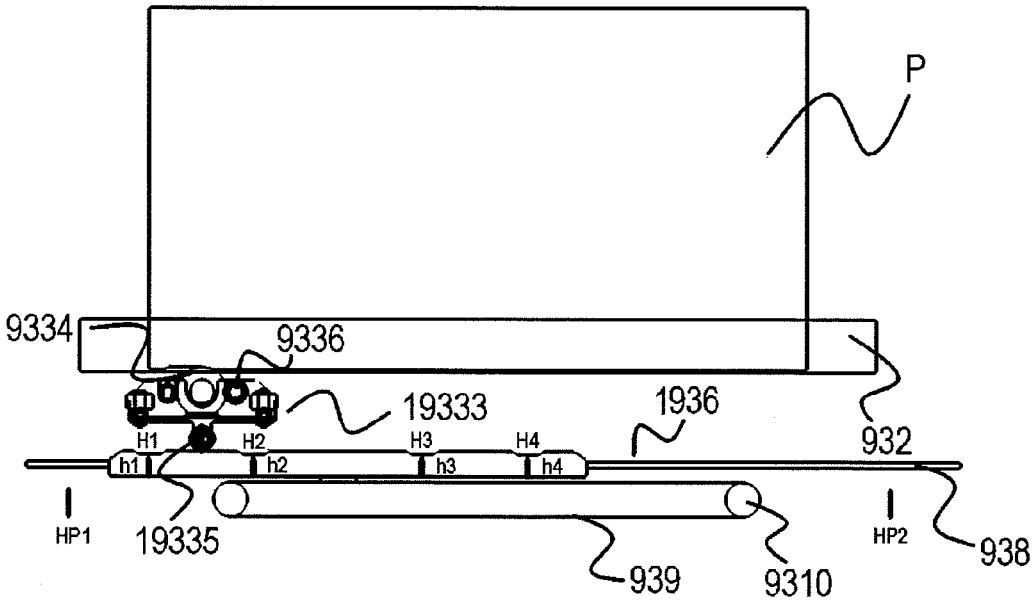

When the press unit supporting plate 1936 stops moving as illustrated in FIG. 11A, the CPU circuit portion 150 starts moving the moving unit 1933 (see FIG. 9) toward the home position HP2 (S6 in FIG. 15). The CPU circuit portion 150 controls the press unit 19333 so that it reaches one end of the spine of the booklet P. As illustrated in FIG. 11B, the CPU circuit portion 150 controls the press unit 19333 so that it passes through the recessed portion H1. The CPU circuit portion 150 determines whether the press unit 19333 passes through the recessed portion H1 (S7 in FIG. 15). When the determination results in YES, the CPU circuit portion 150 controls the press unit supporting plate 1936 so that it moves toward the home position HP2 at the same speed as the press unit 19333 (S8 in FIG. 15). When the determination results in NO, the processing returns to S6 in control of the CPU circuit portion 150.

Figure 12A:
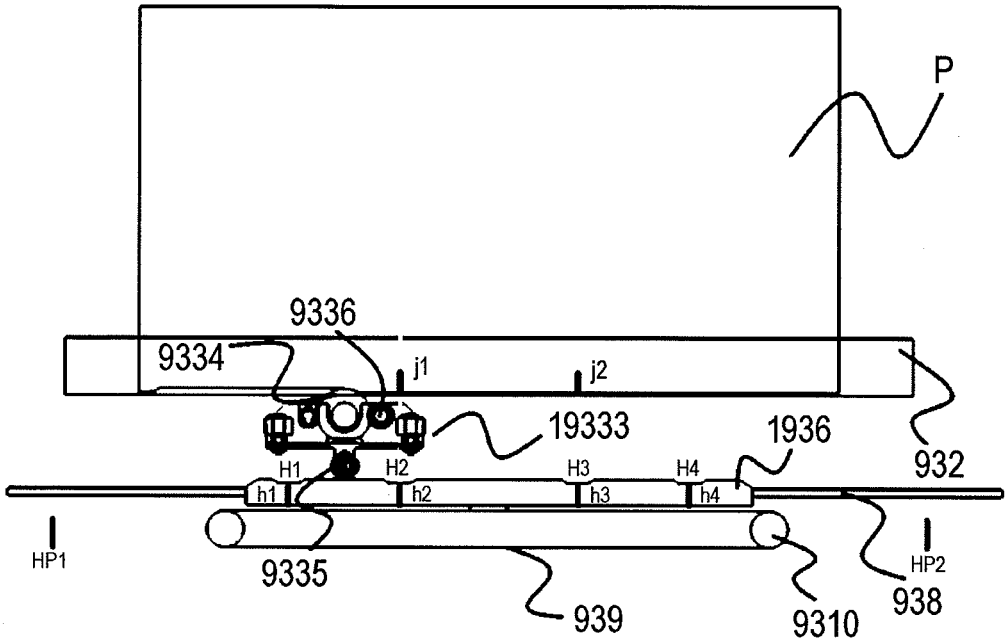
FIG. 12 is a plane view illustrating a configuration of the press unit.

As illustrated in FIG. 12A, the CPU circuit portion 150 determines whether the recessed portion center h2 of the recessed portion H2 reaches the staple j1 of the booklet P (S9 in FIG. 15). When the determination results in YES, the CPU circuit portion 150 stops the press unit supporting plate 1936 (S10 in FIG. 15). When the determination results in NO, the processing returns to S8 in control of the CPU circuit portion 150.

Figure 12B:
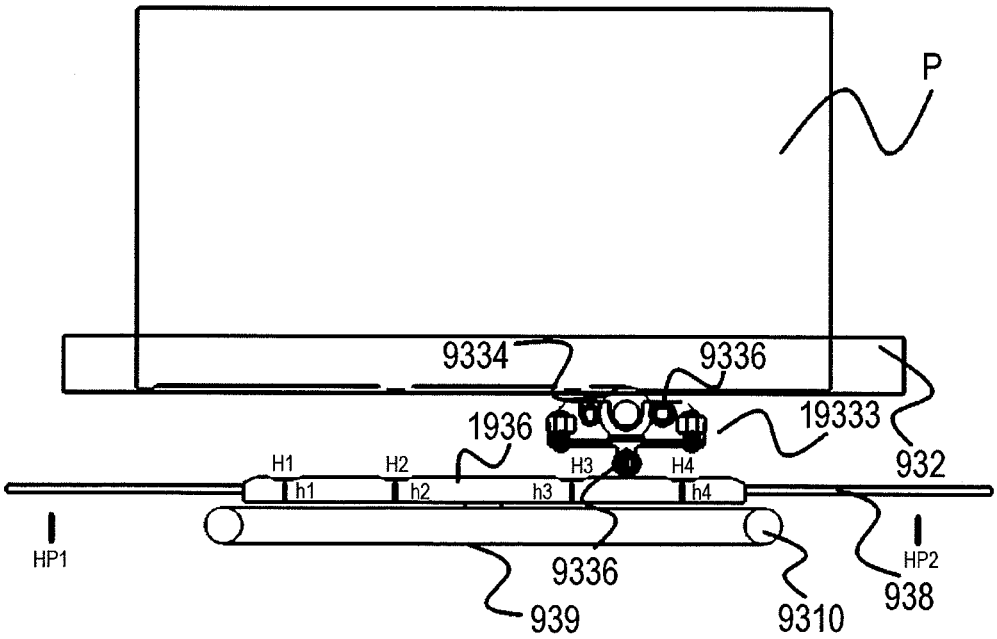
Figure 13A:
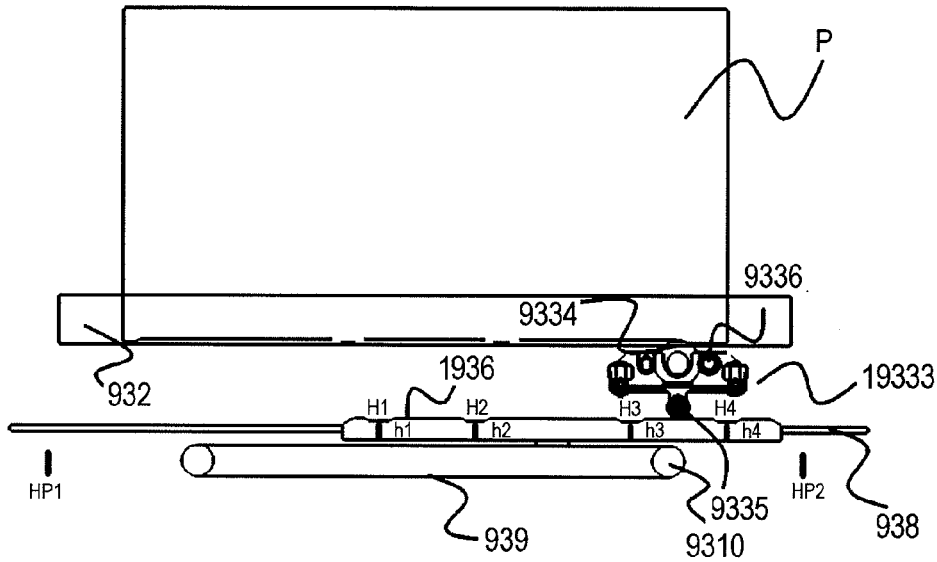
FIG. 13 is a plane view illustrating a configuration of the press unit.
Figure 13B:
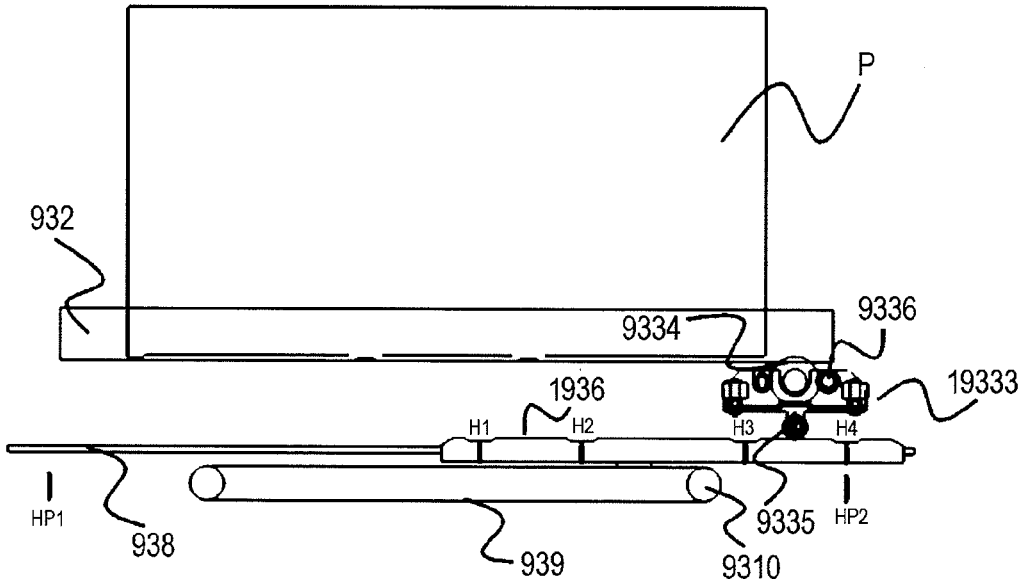

As illustrated in FIG. 12B, the CPU circuit portion 150 controls the press unit 19333 so that it passes through the recessed portion H3. The CPU circuit portion 150 determines whether the press unit 19333 passes through the recessed portion H3 (S11 in FIG. 15). When the determination results in YES as illustrated in FIGS. 13A and 13B, the CPU circuit portion 150 controls the press unit supporting plate 1936 so that it moves toward the home position HP2 at the same speed as the press unit 19333 (S12 in FIG. 15). When the determination results in NO, the processing returns to S10 in control of the CPU circuit portion 150.

The CPU circuit portion 150 determines whether the press unit supporting plate 1936 reaches the second home position HP2 as a result of moving the press unit 19333 and the press unit supporting plate 1936 to the home position HP2 at the same speed (S13 in FIG. 15). When the determination results in YES, the CPU circuit portion 150 stops the press unit supporting plate 1936 (S14 in FIG. 15). When the determination results in NO, the processing returns to S12 in control of the CPU circuit portion 150.

Figure 14A:
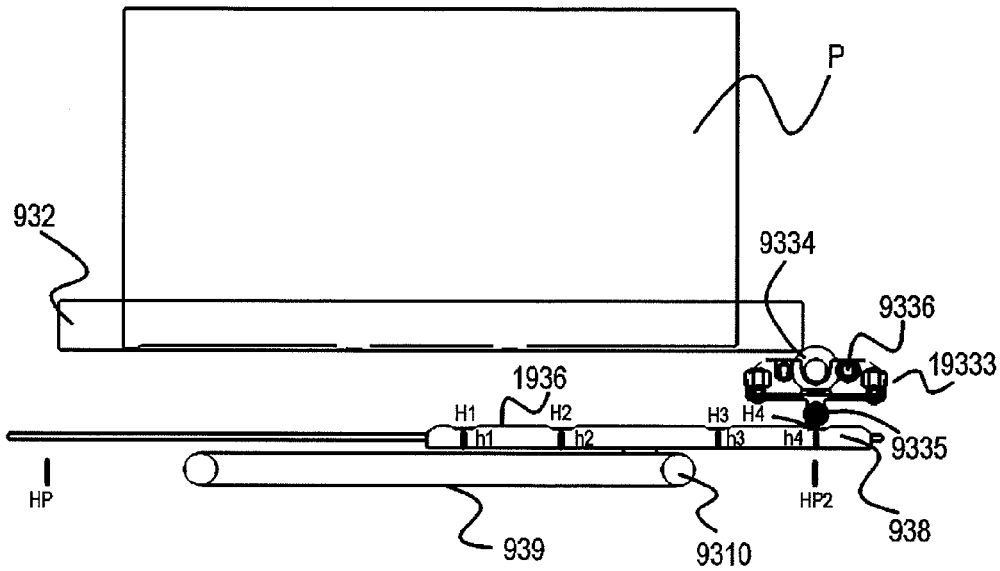
FIG. 14 is a plane view illustrating a configuration of the press unit.
Figure 15:
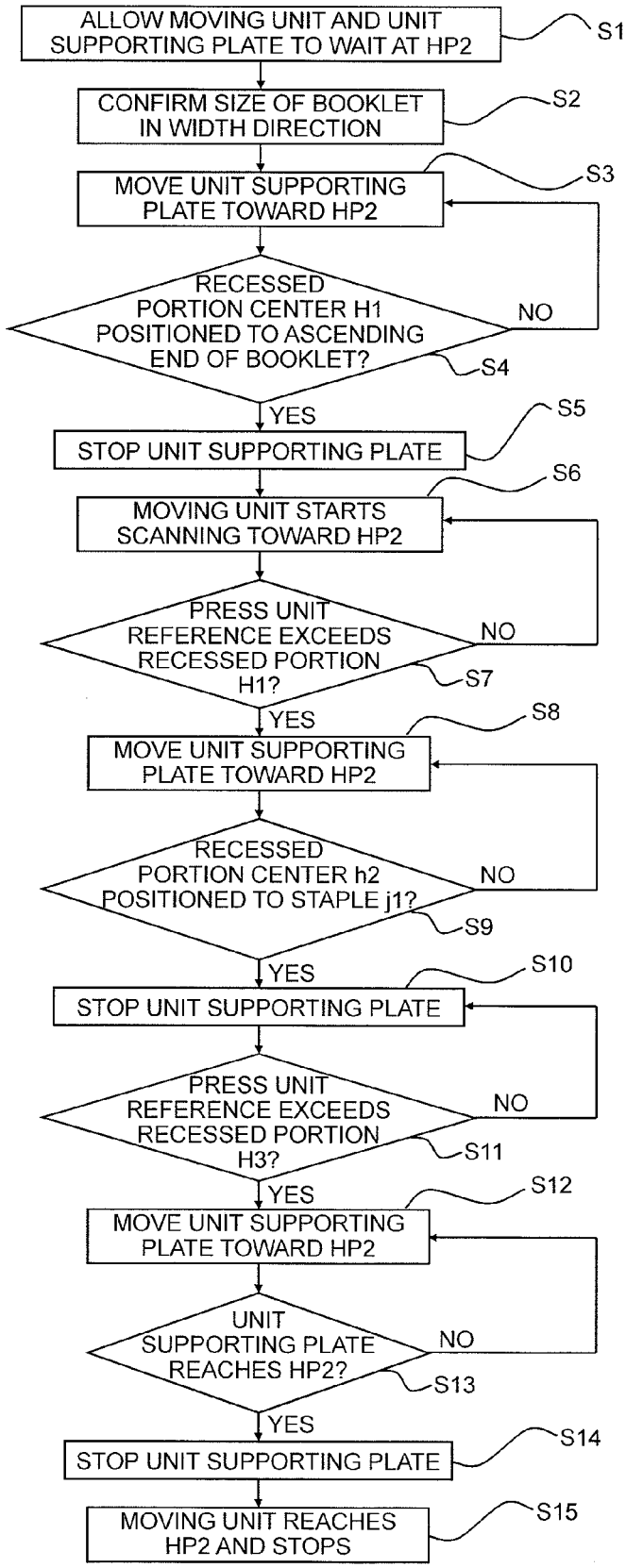
FIG. 15 is a flowchart illustrating a control process of the CPU circuit portion.

As illustrated in FIG. 14A, the CPU circuit portion 150 stops the press unit supporting plate 1936 at the second home position HP2 (S14 in FIG. 15). The CPU circuit portion 150 stops driving the moving unit 1933 (see FIG. 9) assuming that the moving unit 1933 reaches the second home position HP2 (S15 in FIG. 15).

Figure 14B:
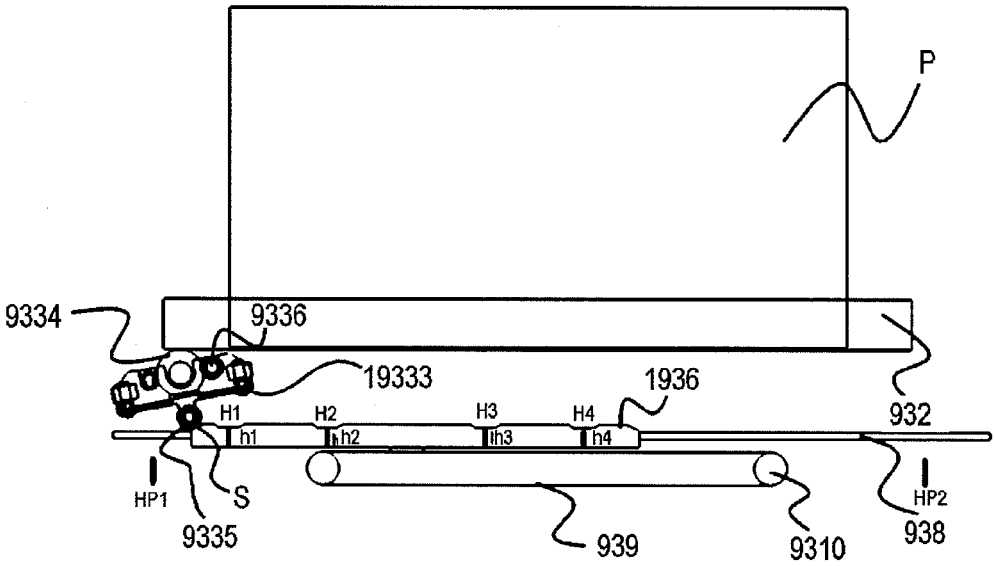

When the press unit 19333 ascends the supporting surface of the press unit supporting plate 1936, the roller 9335 moves up a slope S of the press unit supporting plate 1936 as illustrated in FIG. 14B.

Even though the size of the booklet P changes the end position, the configuration can accordingly change a position to retract the pressing roller 9334.

Figure 16:
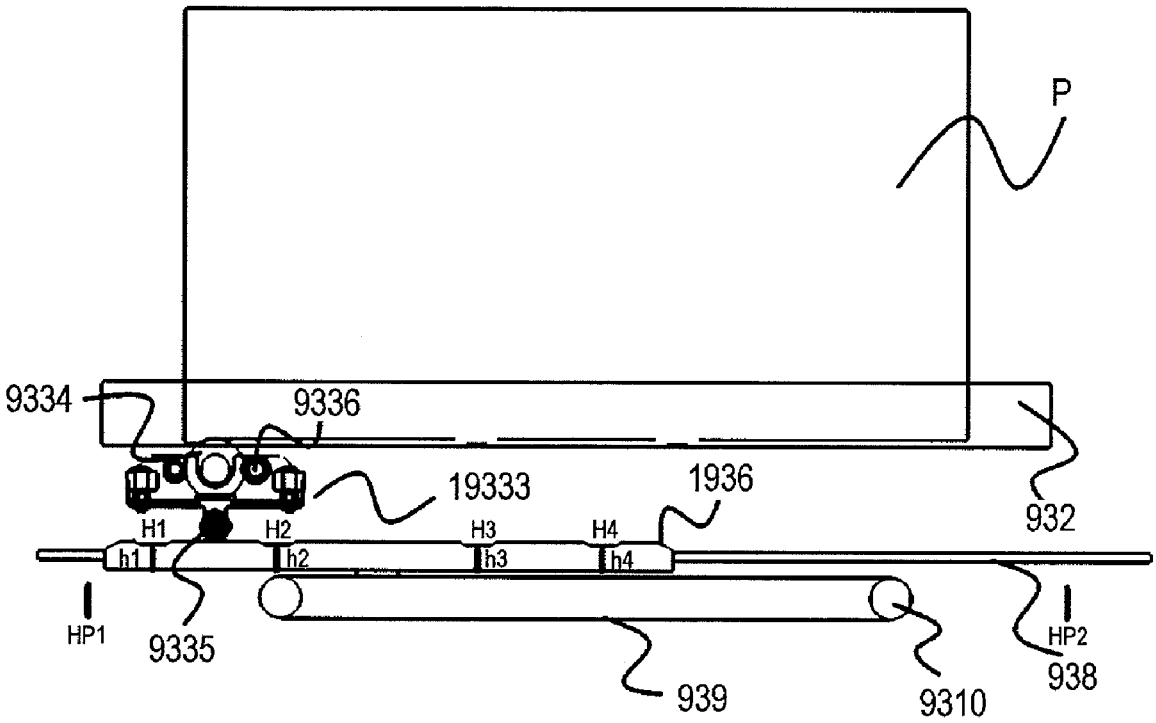
FIG. 16 is a plane view illustrating a configuration of the press unit, a press unit supporting plate, and a moving belt.
Figure 17:
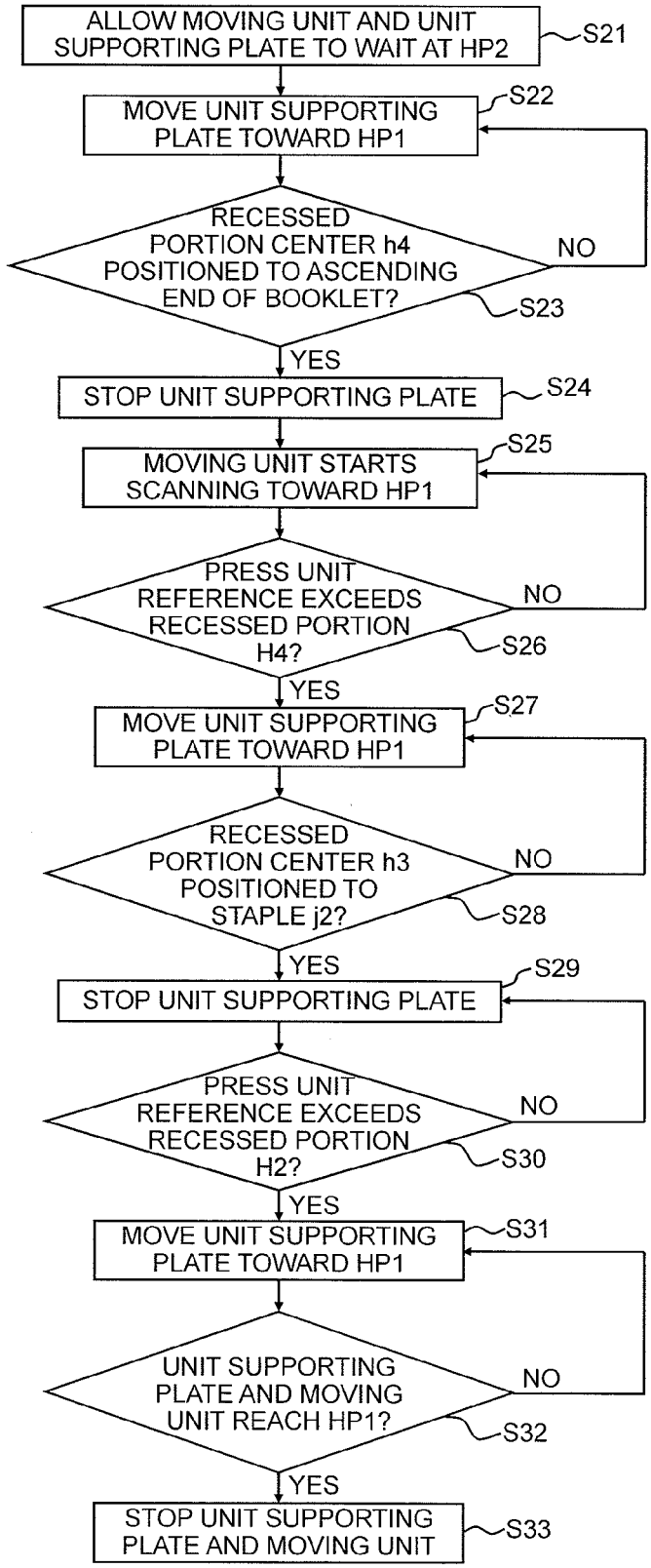
FIG. 17 is a flowchart illustrating a control process of the CPU circuit portion.

FIG. 16 is a plane view illustrating a configuration of the press unit 19333 when it returns to the home position HP during the reciprocal operation. FIG. 17 is a flowchart illustrating a control process of the CPU circuit portion 150. The reciprocal operation during which the press unit 19333 returns to the first home position HP1 will be described as follows.

As illustrated in FIG. 17, the CPU circuit portion 150 allows the moving unit 1933 and the press unit supporting plate 1936 to wait at the second home position HP2 (S21). The CPU circuit portion 150 moves the press unit supporting plate 1936 to the first home position HP1 (S22). The CPU circuit portion 150 determines whether the recessed portion center h4 of the recessed portion H4 on the press unit supporting plate 1936 reaches an ascending end of the booklet P (S23). When the determination results in YES, the CPU circuit portion 150 stops the press unit supporting plate 1936 (S24). When the determination results in NO, the processing returns to S22 in control of the CPU circuit portion 150.

When the press unit supporting plate 1936 stops (S24), the CPU circuit portion 150 moves the moving unit 1933 to the first home position HP1 (S25). The CPU circuit portion 150 determines whether the press unit 19333 exceeds the recessed portion H4 (S26). When the determination results in YES, the CPU circuit portion 150 moves the press unit supporting plate 1936 to the first home position HP1 (S27). When the determination results in NO, the processing returns to S25 in control of the CPU circuit portion 150.

When the press unit supporting plate 1936 moves to the first home position HP1 (S27), the CPU circuit portion 150 determines whether the recessed portion center h3 reaches the staple j2 (S28). When the determination results in YES, the CPU circuit portion 150 stops moving the press unit supporting plate 1936 (S29). When the determination results in NO, the processing returns to S27 in control of the CPU circuit portion 150.

When the press unit supporting plate 1936 stops moving (S29), the CPU circuit portion 150 determines whether the press unit 19333 exceeds the recessed portion H2 (S30). When the determination results in YES, as illustrated in FIG. 16, the CPU circuit portion 150 moves the press unit supporting plate 1936 to the first home position HP1 (S31). At that time, the press unit supporting plate 1936 moves at the same speed as the moving unit 1933. The press unit 19333 passes through a descending end of the booklet P. When the determination results in NO, the processing returns to S31 in control of the CPU circuit portion 150.

When the press unit supporting plate 1936 moves toward the first home position HP1 (S31), the CPU circuit portion 150 determines whether the press unit supporting plate 1936 and the moving unit 1933 reach the first home position HP1 (S32). When the determination results in YES, the CPU circuit portion 150 stops the press unit supporting plate 1936 and the moving unit 1933 at the same time that they reach the first home position HP1 (S33). When the determination results in NO, the processing returns to S31 in control of the CPU circuit portion 150.

Based on the reciprocal movement of the press unit 19333, the pressing member 9334*a* of the pressing roller 9334 evenly squashes both ends of the booklet P. When the moving unit 1933 stops moving, the holding portion 932 is released similarly to the first embodiment. The booklet P is conveyed by the pair of conveying belts 920 and the pair of discharge belts 940 and is discharged onto the tray 950.

Figure 18:
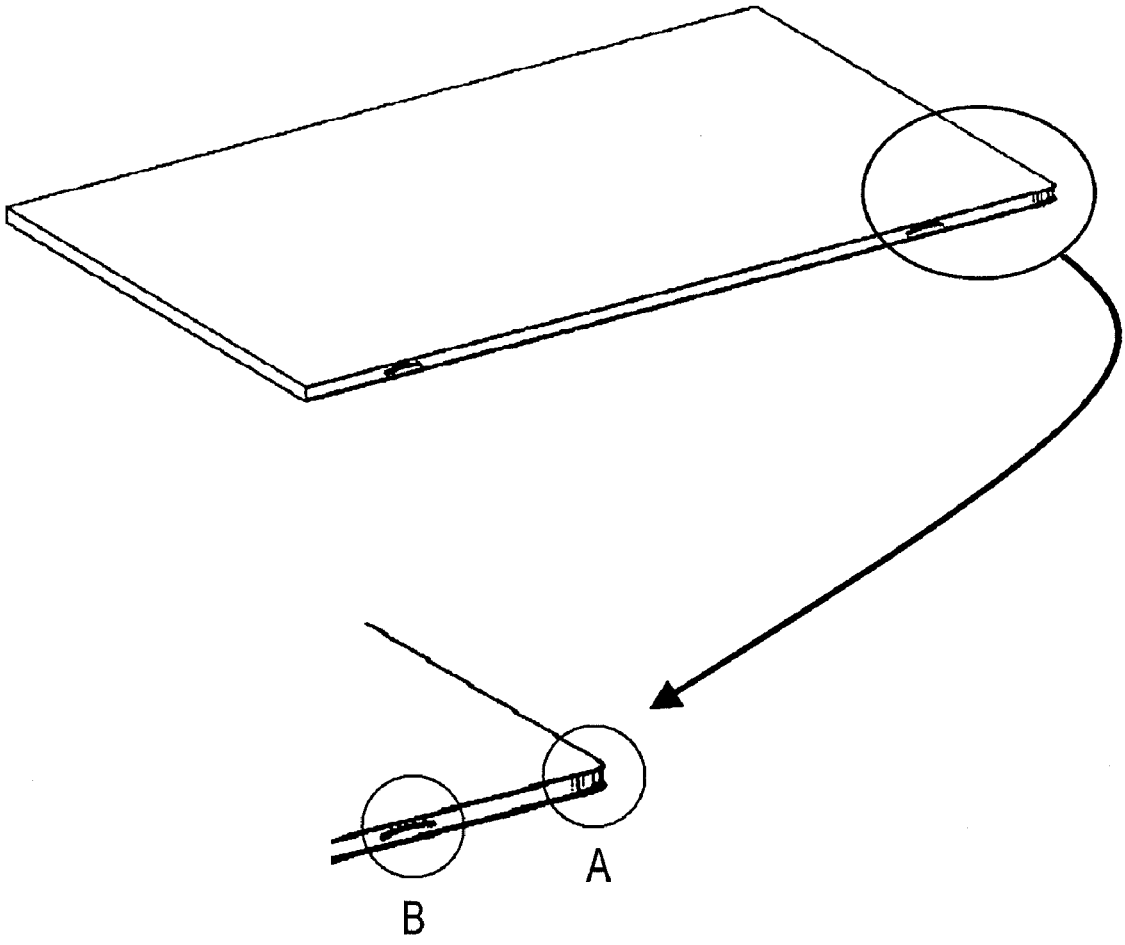
FIG. 18 is a perspective view illustrating an excessive squash and a staple bend at an ascending end of a booklet spine.

As described above, the spine processing apparatuses according to the first and second embodiments suppress an excessive squash and a staple bend at the ascending end where the pressing roller 9334 ascends the spine of the booklet P. FIG. 18 illustrates an example of the excessive squash and the staple bend at the ascending end of the spine of the booklet P.

The spine processing apparatuses according to the second embodiment eliminate the need for a long guide portion even when the spine of the booklet P is long. The press unit supporting plates 935 and 1936 as short guide portions thoroughly press the long spine of the booklet P into shapes. Both ends of the spine of the booklet P are equally shaped, improving the quality of the bound product.

According to the present invention, the pressing portion moves while being guided by the guide portion. The pressing portion can prevent from variability of an amount of squash to a booklet spine when the squaring is performed irrespectively of rigidity of the spine of a folded booklet.

In addition, a guide portion, in the first and second embodiments, includes a recessed portion and a projected portion for increasing, decreasing, or releasing the pressing force to be applied to the spine of the booklet, but the embodiments is not limited to the disclosed exemplary embodiments. For example, the pressing portion may be provided with a motor or a solenoid for driving cam, the pressing force to be applied to the spine of the booklet can be increased, decreased, or released by the cam at a predetermined timing.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2010-007868, filed Jan. 18, 2010, and No. 2010-283976, filed Dec. 21, 2010 which are hereby incorporated by reference herein in their entirety.

What is claimed is:

1. A sheet processing apparatus comprising:

a holding portion which holds a booklet containing a two-folded sheet;

a pressing portion which presses to deform a spine of the booklet held by the holding portion into a square shape during movement along the booklet spine;

a guide portion configured to have a guide surface which guides the pressing portion along the booklet spine at a predetermined distance from the booklet spine; and a recessed portion, provided at a predetermined area of a moving range in which the pressing portion moves along the booklet spine, which guides the pressing portion at a distance further away from the booklet spine than the predetermined distance.

2. The sheet processing apparatus according to claim 1, wherein the predetermined area is located on one end portion of the booklet spine when the pressing portion starts pressing the booklet spine.

3. The sheet processing apparatus according to claim 1, wherein the predetermined area is located on an area containing a staple which is exposed on the booklet spine when the booklet is stapled.

4. The sheet processing apparatus according to claim 1, comprising a moving portion which moves the guide portion parallel to the booklet spine, wherein the recessed portion moves parallel to the booklet spine according to movement of the guide portion based on a driving of the moving portion.

5. The sheet processing apparatus according to claim 1, wherein a booklet to be processed is received from a sheet bookbinding apparatus which staples and folds the booklet containing a plurality of sheets.

6. An image forming system comprising:

an image forming apparatus which forms an image on a sheet; and a sheet processing apparatus, wherein the sheet processing apparatus comprises:

a holding portion which holds a booklet containing a two-folded sheet;

a pressing portion which presses to deform a spine of the booklet held by the holding portion into a square shape during movement along the booklet spine;

a guide portion configured to have a guide surface which guides the pressing portion along the booklet spine at a predetermined distance from the booklet spine; and a recessed portion, provided at a predetermined area of a moving range in which the pressing portion moves along the booklet spine, which guides the pressing portion at a distance further away from the booklet spine than the predetermined distance.

7. The image forming system according to claim 6, wherein the predetermined area is located on one end portion of the booklet spine when the pressing portion starts pressing the booklet spine.

8. The image forming system according to claim 6, wherein the predetermined area is located on an area containing a staple which is exposed on the booklet spine when the booklet is stapled.

9. The image forming system according to claim 6, comprising a moving portion which moves the guide portion parallel to the booklet spine, wherein the recessed portion moves parallel to the booklet spine according to movement of the guide portion based on a driving of the moving portion.

10. The image forming system according to claim 6, wherein a booklet to be processed is received from a sheet bookbinding apparatus which staples and folds the booklet containing a plurality of sheets discharged from the image forming apparatus.

* * * * *